United States Patent [19]

Plitt

[11] Patent Number: 4,905,448

[45] Date of Patent: Mar. 6, 1990

[54] OVERHEAD STRETCH FILM WRAP MACHINES, INCLUDING OVERHEAD STRETCH FILM WRAP MACHINES WITH FILM PRE-STRETCH DEVICES

[75] Inventor: Mike Plitt, Brooklyn, N.Y.

[73] Assignee: Wrapmatic, Inc., Saddle Brook, N.J.

[21] Appl. No.: 289,475

[22] Filed: Dec. 21, 1988

Related U.S. Application Data

[63] Continuation of Ser. No. 55,444, May 29, 1987, abandoned.

[51] Int. Cl.[4] ..... B65B 13/04

[52] U.S. Cl. ..... 53/399; 53/441; 53/449; 53/556; 53/588; 53/176

[58] Field of Search ..... 53/399, 441, 556, 587, 53/588, 176, 449

[56] References Cited

U.S. PATENT DOCUMENTS

| | | | |
|---|---|---|---|
| 4,067,174 | 1/1978 | Goldstein | 53/210 |
| 4,079,565 | 3/1978 | Lancaster | 53/556 X |
| 4,109,445 | 8/1978 | Shulman | 53/588 X |
| 4,282,700 | 8/1981 | Goldstein | 53/556 |
| 4,409,776 | 10/1983 | Usui | 53/441 X |
| 4,587,796 | 5/1986 | Haloila | 53/588 |
| 4,628,667 | 12/1986 | Humphrey | 53/399 |
| 4,722,170 | 2/1988 | Ball | 53/588 X |

FOREIGN PATENT DOCUMENTS

| | | | |
|---|---|---|---|
| 32140 | 7/1981 | European Pat. Off. | 53/556 |
| 2810124 | 9/1978 | Fed. Rep. of Germany | 53/210 |
| 3344940 | 6/1985 | Fed. Rep. of Germany | 53/556 |
| 3431628 | 3/1986 | Fed. Rep. of Germany | 53/588 |

*Primary Examiner*—John Sipos

*Attorney, Agent, or Firm*—Fred A. Keire

[57] ABSTRACT

An overhead stretched film wrapping apparatus, wherein the carriage carrying the film dispenser is adjustable upwardly or downwardly during the overhead wrapping; pre-stretched film dispensing devices and gantry mounted variations are also disclosed.

4 Claims, 9 Drawing Sheets

FIG. 6
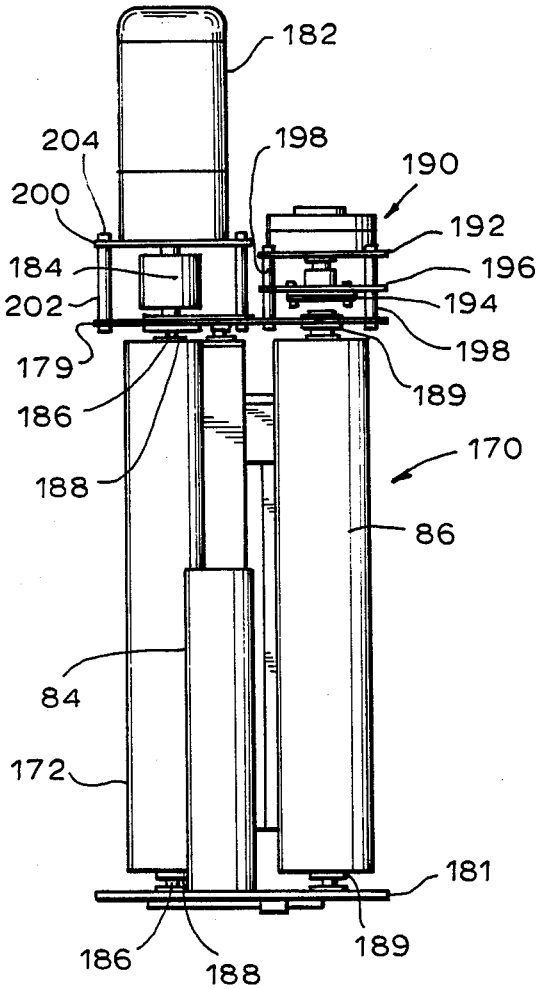
FIG. 6a
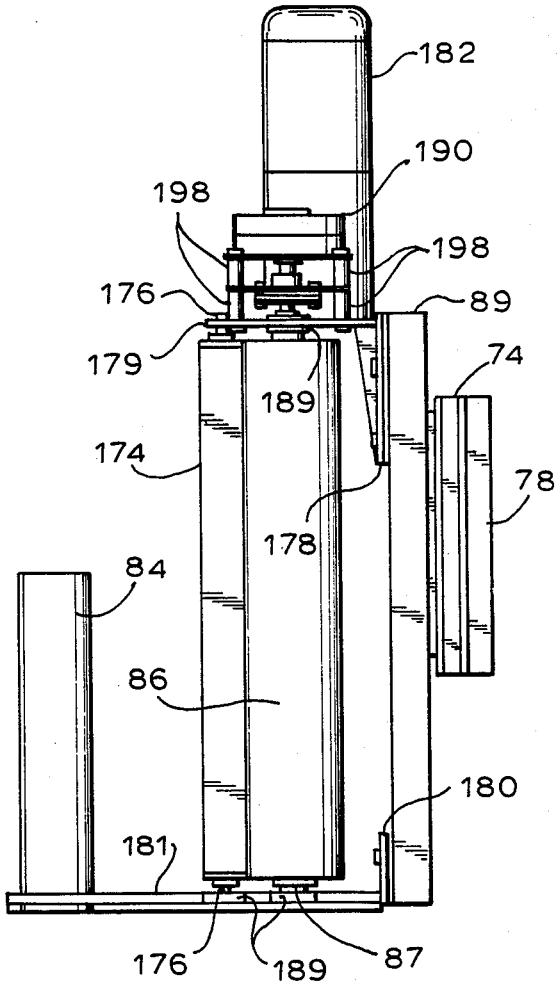
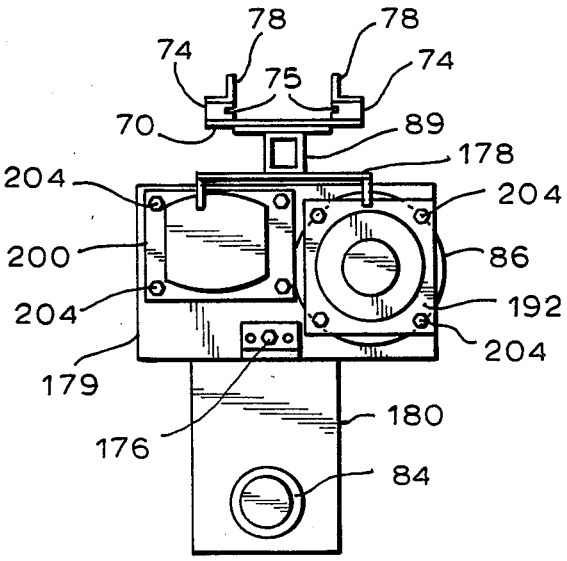
FIG. 6b

OVERHEAD STRETCH FILM WRAP MACHINES, INCLUDING OVERHEAD STRETCH FILM WRAP MACHINES WITH FILM PRE-STRETCH DEVICES

This application is a continuation of application Ser. No. 055,444, filed May 29, 1987, now abandoned.

This invention relates to a machine for wrapping loads with a film which is stretched when wrapped around the load. More particularly, this invention relates to machines which are capable of operating in an overhead manner, i.e., over a load, when wrapping a load.

Further, with these machines the film may be wrapped around the load from a crank arm describing a 360 degree circular motion, either horizontally or vertically. Accordingly, with the novel machines the film is being wrapped around the load either in a spiral or variable mode, or in a combination or interrupted layer mode. Thus, at any location of the load, a pre-determined number of layers may be wrapped.

Accordingly, substantially overlapping layers are formed, but interrupted vis-a-vis the height or the length of the load. Any combination of these modes is possible as a result of the film being dispensed from a film dispensing device intermittently or continuously positioned vis-a-vis the load height or length during the application of the film as it is being wrapped around the load in a stretched or pre-stretched mode.

Still further, this invention relates to an overhead stretched film wrapping machine which may have more than one film dispensing device on a rotated arm. A wall attached film wrapping machine may also be floor mounted or mounted on an industrial truck or a gantry mounted unit having one or more film dispensing means are described and disclosed herein. Further, the machine of the wall attachment type may be mounted on an industrial truck, both in the "wall" attached mode or in the "vertical circle" describing mode.

Associated conveying means and means for positioning the load in a position in which wrapping may take place have been described as a further combination.

Various means for adjustment of the film dispensing devices have been described, as well as the combination of the various patterns obtainable with differently adjustable film dispensing means. Of the above-described units, the overhead wrapping machine represents the preferred embodiment.

BRIEF DESCRIPTION OF THE PRIOR ART

U.S. Pat. No. 4,079,565 describes a stretch wrapped package process and apparatus which allows a fork lift truck to move a load into a position for wrapping the load with a full width film. No spiral or intermittent film wrapping is possible according to this patent. Rotation is only in a manner such that a vertical circle is described. No provisions for describing a horizontal circle have been provided with means adjustable to wrap loads interruptedly or in a spiral fashion, or any combination of these.

Further, U.S. Pat. No. 4,429,514 describes a rotatable stretching apparatus with a pre-stretching mechanism. This apparatus includes a forklift means that provides for wrapping a load with a film in a full film web wrapping device. No spiral or interrupted web placement is possible with the apparatus as disclosed in that patent. The apparatus is considerably less flexible for load manipulation than the present apparatus of the same type and requires manipulative steps unnecessary for the present machines.

In U.S. Pat. No. 4,549,388, dated Oct 29, 1985, a unitary completely wrapped package has been disclosed which relies on the wrapping of an underlying carriage in a ring wrapping machine such as in a spiral wound fashion. The removal of the undercarriage or support carriage of the apparatus causes the stretched film to revert to its less stretched conditions and envelops the package. The conveying means, as well as the various devices associated with the wrapping apparatus, make it fairly complicated and difficult to wrap a load in a straightforward manner. Essentially the same disclosure is also shown in U.S. Pat. No. 4,317,322 with the same attendant complications and the like.

A number of other prior art patents and prior art has been discussed in these previously mentioned references and are not intended to be repeated, but any reference for background information is made with respect to the above-mentioned patents as well as the art discussed and cited therein. Further patents are listed by reference to the art as background material, including the art cited in these patents. These are: U.S. Pat. No. 3,867,806 dated Feb. 25, 1975 to Lancaster et al.; U.S. Pat. No. 4,050,221 dated Sep. 27, 1977 to Lancaster et al.; U.S. Pat. No. 4,077,179 dated Mar. 7, 1978 to Lancaster et al.; U.S. Pat. No. 4,204,377 dated May 27, 1980 to Lancaster et al.; U.S. Pat. No. 4,235,062 dated Nov. 25, 1980 to Lancaster et al.; U.S, Pat. No. 4,255,918 dated Mar. 17, 1981 to Lancaster et al.; U.S. Pat. No. 4,271,657 dated June 9, 1981 to Lancaster et al.; U.S. Pat. No. 4,300,326 dated Nov. 17, 1981 to Stackhouse; U.S. Pat. No. 4,302,920 dated Dec. 1, 1981 to Lancaster et al.; U.S. Pat. No. 4,317,322 dated Mar. 2, 1982 to Lancaster et al.; U.S. Pat. No. 4,336,679 dated June 29, 1982 to Lancaster et al.; U.S. Pat. No. 4,387,548 dated June 14, 1983 to Lancaster et al.; U.S. Pat. No. 4,387,552 dated June 14, 1983 to Lancaster et al.; U.S. Pat. No. 4,418,510 dated Dec. 6, 1983 to Lancaster et al.; U.S. Pat. No. 4,465,450 dated Aug. 14, 1984 to Dermansky; U.S. Pat. No. 4,497,159 dated Feb. 5, 1985 to Lancaster; U.S. Pat. No. 4,514,955 dated May 7, 1985 to Mouser et al.

BRIEF DESCRIPTION OF THE PRESENT INVENTION

In accordance with the present invention, a wrapping apparatus for a film wrapping or a pre-stretch film wrapping have been disclosed which provide a number of benefits associated with a novel ability to wrap a load from an overhead rotating rotor arm having one or more film dispensing devices for wrapping a film around a load spirally or interruptedly or in any combination of these and at any desired count of layers, especially if one or more of the film dispensing devices have been provided. A wall mounted unit which accomplishes the above wrapping provides for excellent safety as the film dispensing device rotates perpendicularly to the ground.

Still further, the same device, if floor mounted, also is capable of wrapping a load in a manner such that a pallet positioned with a forklift and the like may be wrapped in a spiral or interrupted fashion around the entire load or at any suitable location on the load without displacing the load during the wrapping operation.

Still further, a rotor arm positioned on a gantry may also be used, having either one or more film dispensing devices for adjustably, i.e., spirally, non-spirally or interruptedly, wrapping a load. In the device as described in connection with the gantry, the film is dispensed perpendicular to the ground and the rotation of the film dispensing device is around the load.

Still further, any combination of the machines may place spirally wrapped film, either in the stretch-as-wrapped mode or pre-stretch and wrap mode, around the load. As it is well known, a pre-stretched film requires very little force when wrapping a load, but instead relies on load integrity when the pre-stretched film retains its "memory", i.e., reverts back to a less stretched state.

In describing the above combinations, appropriate conveyors may be used in combination with the stretch wrapping apparatus such that any desirable pattern for wrapping may be obtained as dictated by the load components, the configuration of the load, shipping requirements, and the like. Loads such as standard 50 inch by 50 inch pallet loads may be wrapped, but larger and smaller loads may likewise be wrapped.

As a consequence of the present invention, great freedom for variations in wrapping is provided. For example, in a two film dispensing device a film may be dispensed in which in one layer a film is a full width film and in another layer it is a spirally wrapped film. Such multiple reinforcements in the wrapping provide an excellent package with outstanding characteristics. These loads are now capable of long distance hauling by trucks and the like on fairly poor roads where the loads would normally shift and/or be severely displaced from their originally wrapped position. In accordance with the present invention, the load as wrapped by the present devices and apparatus maintains great integrity under the most severe transportation conditions heretofore very difficult to achieve with the available machines.

Still further, the other benefits which are obtained relate to the very desirable overhead functions which allows the internal adjustment between the rate of rotation of a rotor arm and the rate at which the film dispensing device is positioned, i.e., from a rate of zero to a suitable rate of vertical (or horizontal) travel.

Additionally, after its spiral formation a machine may be returned to its previous starting position or any other position.

Consequently, the down time for wrapping a package is substantially eliminated and alternative wrapping from bottom to top and from top to bottom allows faster operating rates and production cycles in both the horizontal circle model as well as in the perpendicular circle model.

These advantages have been especially desirable, not only for small package wrapping, but also for heavy load wrapping as the heavy load need not be rotated but a rotor arm holding the film dispensing device can now be easily rotated. The relative mass of the crank arm vis-a-vis the load provides especially sizeable benefits for very heavy loads.

Still additional advantages reside as a result of the overhead function to combine the device with an industrial truck, e.g., a jitney, a fork lift, or the like.

BRIEF DESCRIPTION OF THE DRAWINGS

The above-described benefits and advantages, as well as further benefits, will become apparent from the further description of the invention as set forth in the following embodiments which have been taken in connection with the above and the accompanying drawings forming part of this application; in the drawings, like reference numerals refer to like parts or parts functioning in an equivalent manner throughout the several views and several embodiments which have been disclosed herein and in which:

FIG. 2*a* shows a top elevational view of the apparatus shown in FIG. 2 with the load placement combinations used therewith;

FIG. 6 is a front elevational view of a film dispensing device of the pre-stretched film type also illustrated in FIGS. 2 and 3;

FIG. 6*a* is a side elevational view of the film dispensing device as shown in FIG. 6, illustrating in further detail a slide means for adjustment of the film dispensing device shown in FIG. 6;

FIG. 6*b* is a top elevational view of the device shown in FIG. 6, including the slide means and a carriage plate also shown in FIG. 6*a;*

Turning now to the drawings, FIG. 1 shows the apparatus identified generally as 10 which is a wall mounted version. The overhead stretch film wrapping apparatus 10 may have the film dispensing device 80 or a film dispensing device of the pre-stretch type 170 further shown in FIGS. 6 to 6*b*. The wall mounted apparatus 10 consists of the stationary arm 11 having a flat wall plate 12 with an appropriate number of holes for securing with bolts and the like (not shown) the wall plate 12 to a suitable wall.

Figure 1:
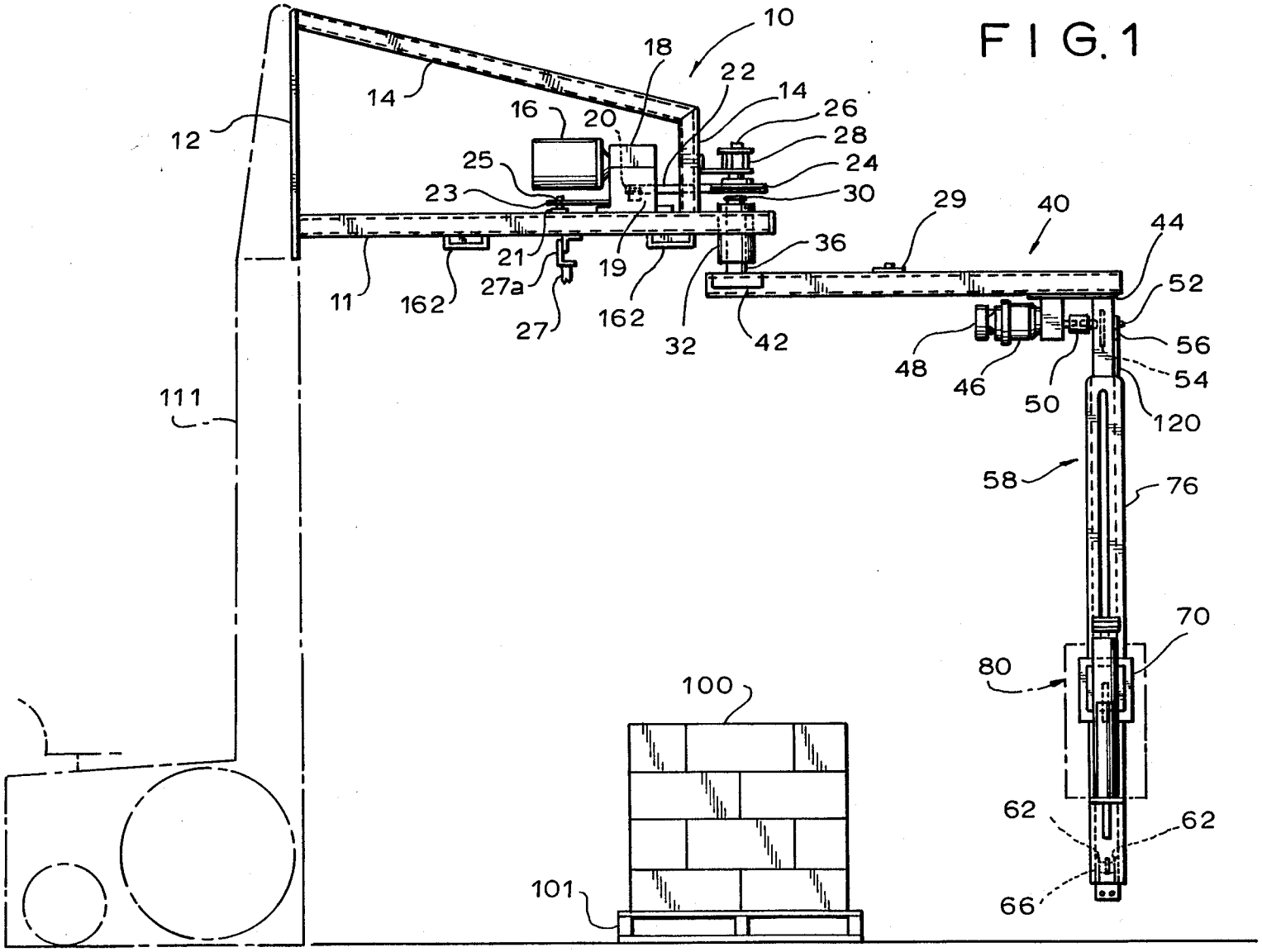
FIG. 1 discloses a side elevational view of the invention for the wall mounted apparatus.

Bracings 14 for the stationary arm 11 have also been shown. Obviously, bracings 14 may take various forms.

A motor 16 for driving a rotor arm 40 after appropriate reduction of the rpm's in gear box 18 is mounted on stationary arm 11 on an appropriate mounting device 19. Motor 16 is a clockwise or counterclockwise rotating motor, preferably a D.C. motor, e.g., ½ horsepower. Motor 16 may drive the rotor arm 40 clockwise or counterclockwise. Typically the revolutions per minute (rpm) by the motor 16 may be reduced in a gear box 18 to where the rotor arm 40 rotates at about 5 to about 12 rpm. The rotor arm 40 is rotated by a sprocket 20 driving a sprocket chain 22 which engages a corresponding and appropriately sized driven sprocket 24. In turn, the driven sprocket 24 is mounted on shaft 26 for rotor arm 40. A slip ring device 28 for transmitting electrical power to the rotor arm 40 where needed has also been shown as mounted on shaft 26. A spacer 30 for shaft 26 has been provided. A bearing 32 mounted within stationary arm 11 supports shaft 26. There is a bushing 36 for shaft 26, the details of which will be further described in FIG. 4.

Figure 5:
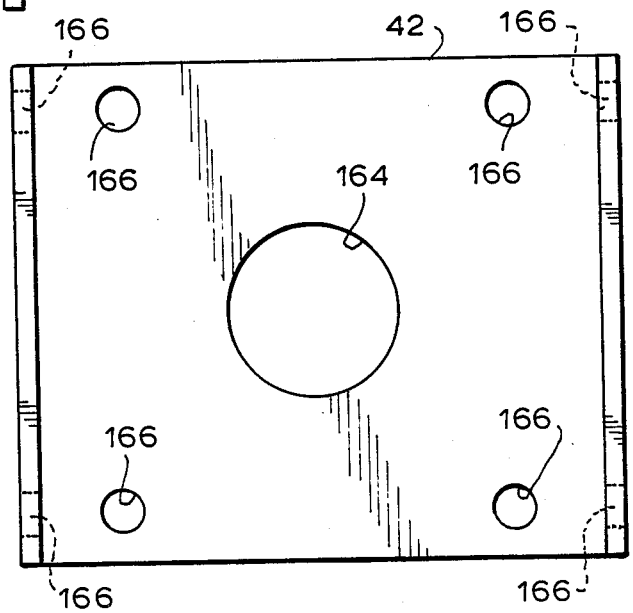
FIG. 5 shows a top plan view of the rotor support shown in FIGS. 4 or 1, 2 and 3.
Figure 4:
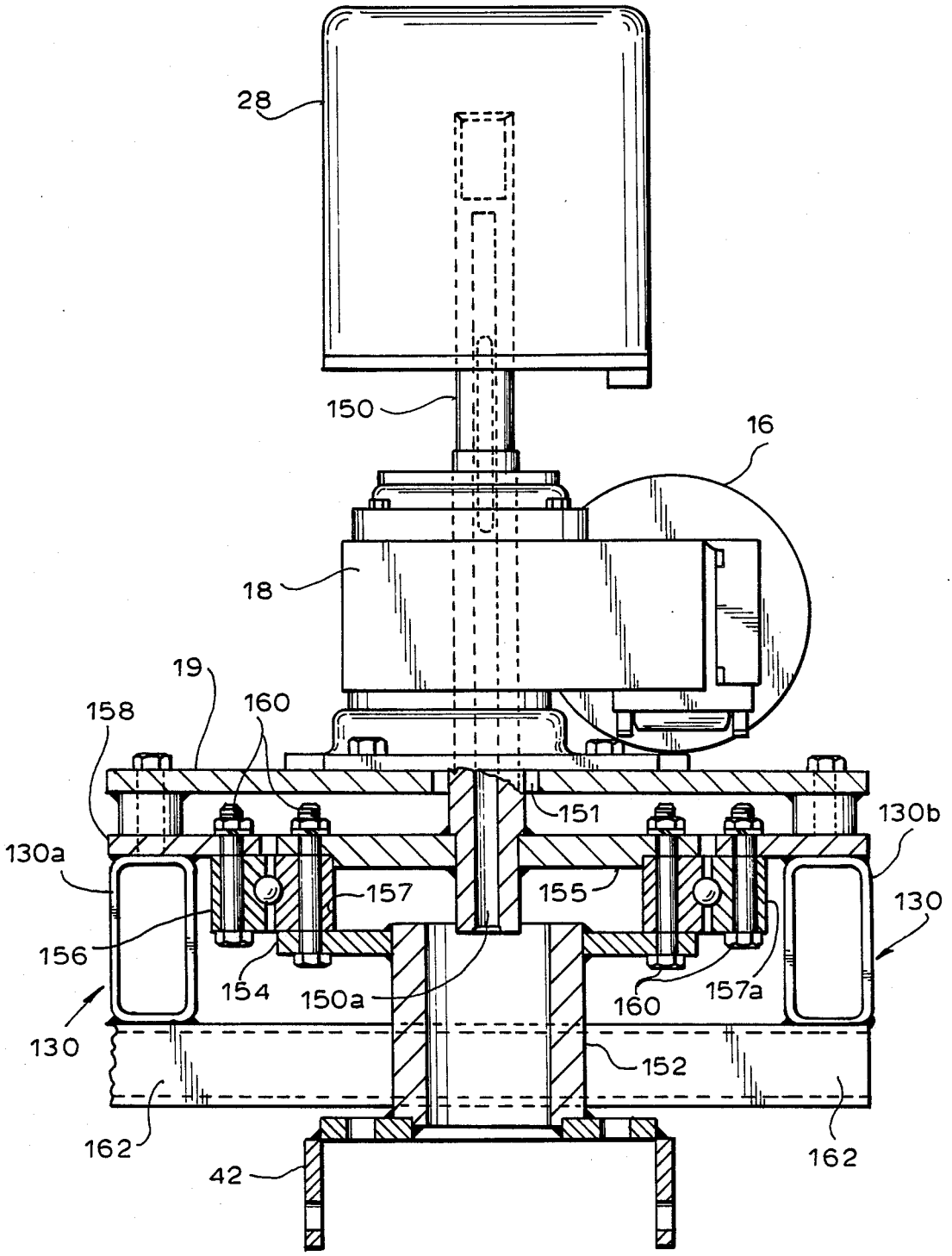
FIG. 4 illustrates a rotor shaft assembly in a partial cross-sectional view, including schematically the associated motor gearing and slip control means suitable for the devices shown in the illustrations in FIGS. 1, 2 and 3, and/or equivalent to the devices as shown in FIGS. 1, 2 or 3.

Rotor arm 40 is supported by rotor arm support 42, the details of which will be shown in FIGS. 4 and 5. In order to achieve an appropriate tensioning of chain 22, a take up bracket 21 having a take up bolt 23 with an appropriate locking device 25 is mounted on the stationary arm 11. A limit switch 27 and its bracket 27*a* is also mounted on stationary arm 11. A corresponding limit switch trigger 29 is schematically shown and is mounted on rotor arm 40. Hence, limit switch 27 may act as an index for showing the number of revolutions of rotor arm 40 or for control device or as a shut-off trigger for the rotor arm 40.

A mounting plate 44 for gear motor 46 is on rotor arm 40. Gear motor 46 also includes brake 48 therefor. Again, gear motor 46 is a clockwise or counterclockwise rotating motor. It may also be a variable speed motor, e.g., a D.C. motor. This motor may be typically a ½ horsepower A.C. motor or a ¼ horsepower D.C. motor.

A coupling 50 interconnects the gear motor 46 with top shaft 52 driving top shaft sprocket 54 and a sprocket chain 68 wound around top shaft sprocket 54. A bearing 56 for top shaft 52 is supported in the upright arm 58.

Figure 7B:
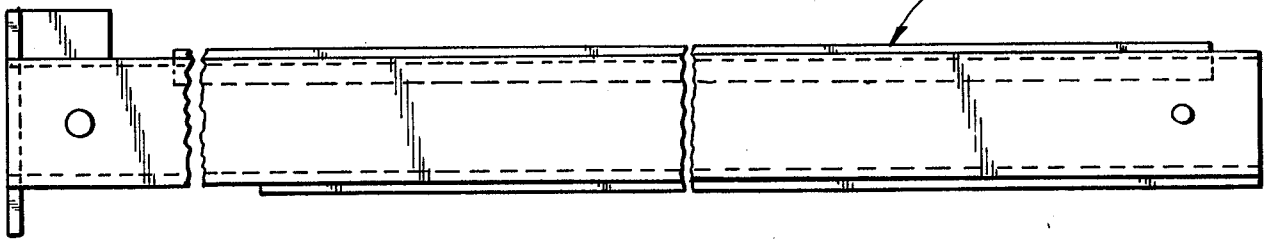
FIG. 7*b* illustrates the rear elevational view of the device shown in FIG. 7.

One end of chain 68 interconnects with carriage plate 70 via the chain tensioner 72 mounted on carriage plate 70. Chain 68 via chain tensioner 72 moves carriage plate 70. The other end of the chain 68 runs over bottom sprocket 64, such as shown in FIG. 1*b* and interconnects with carriage plate 70 via the chain tensioner 72. The bottom sprocket 64 is mounted on bottom shaft 60 and supported by bottom shaft bearing 62, constrained by bottom shaft collars 66. Thus bottom shaft collars 66 act as spacers for bottom sprocket 64 confined on the bottom shaft 60 between the appropriate bearings 62. Carriage plate 70, in turn, has two slides 74 which ride on slide rail 76. The chain tensioner 72 will be further illustrated in FIG. 8; the upright arm 58 in FIGS. 7 to 7*b* and the slides 74 and the various components parts thereof, in FIGS. 6*a* and 6*b*.

Figure 1A:
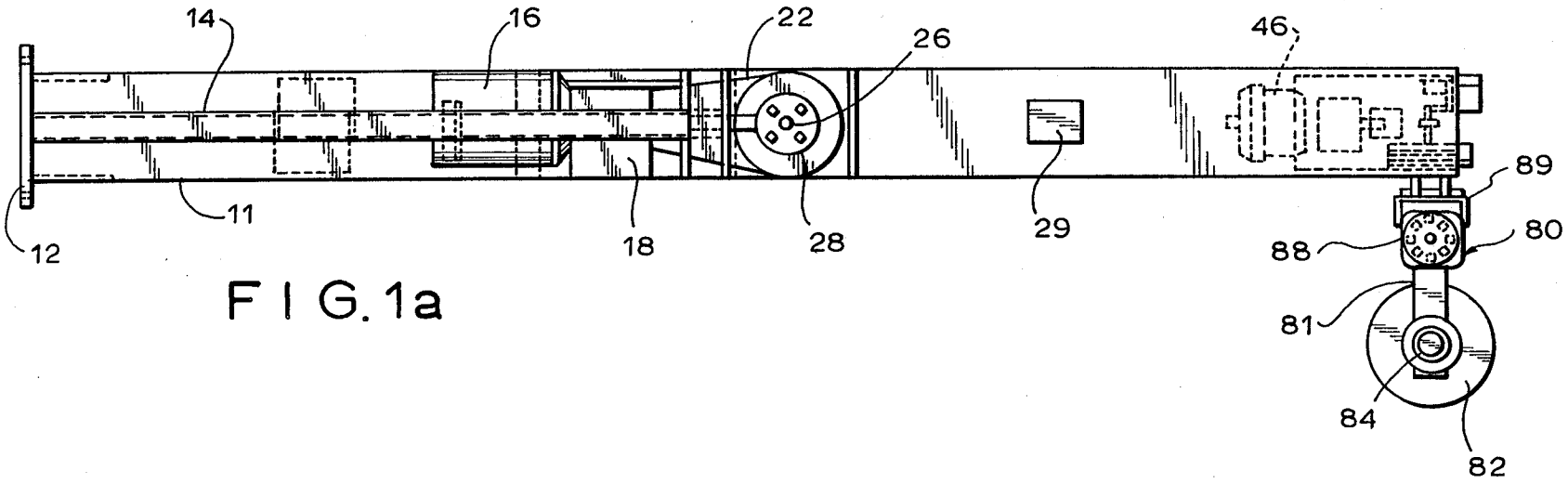
FIG. 1*a* discloses the top view of the apparatus shown in FIG. 1.
Figure 1B:
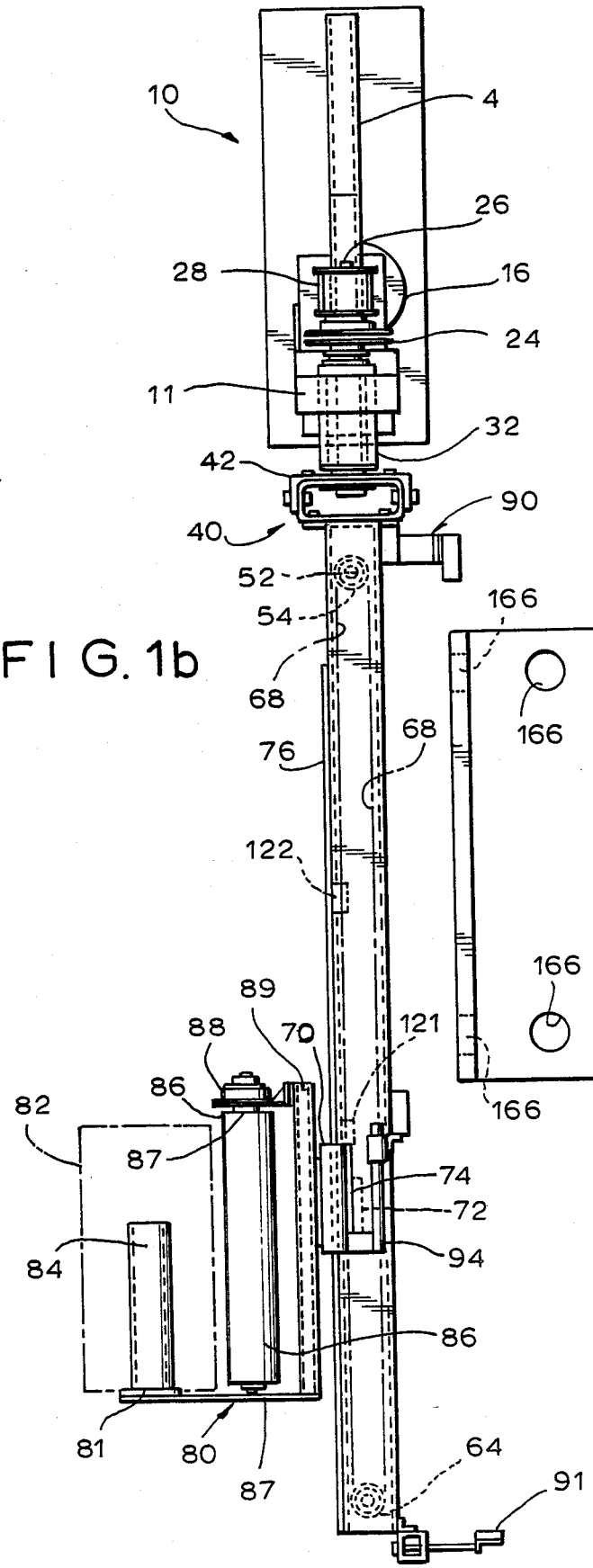
FIG. 1*b* discloses the front elevational view of the apparatus shown in FIG. 1.

A film dispensing device is shown as 80 in FIGS. 1, 1*a* and 1*b*. In FIG. 1*b*, 82 identifies a roll of film and film 83 in phantom lines which is mounted on a film roll tube holder 84. A brake roller 86 for the film coming off the film roll 82 is controlled by brake 88 for brake roller 86. The support bracket is 81 for the brake roll 86 and the film roll 82, and at the top the brake roller is supported by top bracket 89. Bearings 87 are mounted on support bracket 81 and top bracket 89, thereby supporting brake roller 86.

The brake 88 for the brake roll 86 is an electromagnetically operated brake and can be adjusted to control the degree to which the film is being stretched as it is being wound around a load. This brake is known as a magnetic particle brake and is available from Placid Industries, Lake Placid, New York. In addition, various safety devices may be mounted on the apparatus such as an eye 90 and a reflector therefor 91 with appropriate bracket attachments (not described) to the upright member 58. The photoelectric eye 90 stops the apparatus such as when its circular path is interrupted and an obstruction occurs in the circular path of the apparatus. Similarly, a photoelectric eye may be attached to the upright 58 to sense the presence, absence or height of a load (such photoelectric eye has not been shown). Likewise, a photoelectric eye which stops the film dispensing device 80 has been shown as 92 which stops the motor 46 when the eye is covered.

A bracket for the photoelectric eye 92 is shown as 94 and is carried on the upright arm 58.

In FIG. 2*a*, a floor mounted apparatus of the type of the apparatus shown in FIG. 1 has been illustrated.

This device in its essential elements has all of the identical components, except for the film dispensing device which is of the pre-stretch type.

This aspect of the invention will be further discussed herein in connection with the drawing shown in FIGS. 6 to 6*b*. A difference in the device shown in FIG. 2 is another mode for mounting the motor 46 which in this instance is shown in FIGS. 2 and 2*a* and is perpendicular to the rotor arm 40.

Figure 2:
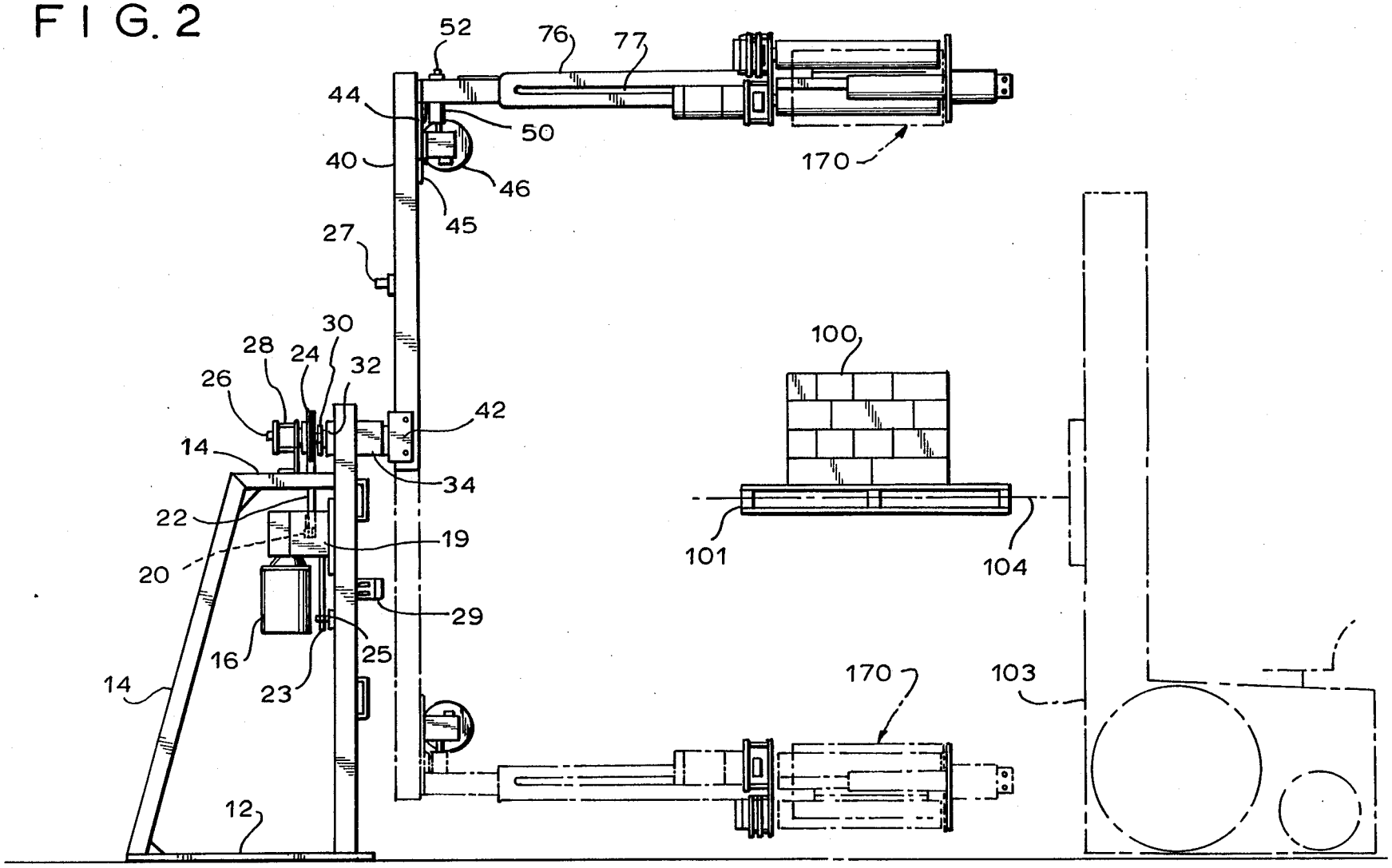
FIG. 2 discloses a side elevational view of an apparatus similar to that shown in FIG. 1, but in the floor mounted version thereof.

For the floor mounted apparatus as shown in the drawing in FIG. 2, a load 100 which has been stacked on a pallet 101 and placed in position by a forklift device 103 has been illustrated. Forks 104 appropriately position the load at the approximate center of shaft 26 so that the rotor arm 40 may move the film device 80 around the load 100 and dispense a wrapping film 83, either as a full wrap or as a spiral wrap or intermittent wrap, i.e., around the pallet and the load 100. Still further and as part of the present invention, the device as shown in FIG. 1 may be appropriately mounted on an industrial truck 111 or jitney which can be driven up to the load 100 and the entire load then wrapped in place. Afterwards the operator of the industrial truck 111 can then proceed to the next load and similarly have it wrapped.

The motors, such as motors 16 and 46 and any associated circuitry (being typically of the D.C. type), switches for the electric cells and the like, may be interconnected to a generator on the industrial truck 111. Such truck 111 may also be operated with an A.C. power generator via an internal combustion engine or an hydraulically driven system where the motor 16 may be hydraulically driven and the motor 46 may be electrically driven.

The appropriate electrical interconnections, such as rotating contacts on the devices, have not been shown in detail but are represented by the slip ring device 28. These devices are well known in the art and are readily purchased on the market.

Instead of the chain 68 guiding the chain tensioner 72, the slide 74, or carriage plate 70, a worm gear shaft with a worm gear tube rotating in a left and right-hand fashion may be employed (not shown). Thus in place of the upper sprocket 54, a right angle beveled gear interconnection (not shown) between the motor 46 and the rotating worm gear shaft may be used. A further like equivalent is a rack and pinion arrangement. With the rack permanently mounted in the upright arm 58 and an electrically driven pinion (and a motor therefor) interconnected with the carriage plate 70 and slides 74 to drive the film dispensing device 80 in a reciprocating motion on slide rail 76 for the length of the load in a manner as best determined for that particular load.

In FIG. 1, a magnetically activated switch may also stop the film dispensing device 81 from further moving up the upright arm 58 on slide rail 76. The magnetic guide has been shown as 120. An appropriately located magnetic switch 121 is stopped by a magnet 122. The magnet 122 may be thus positioned manually on magnetic guide 120 any place on the upright arm 58.

Figure 3:
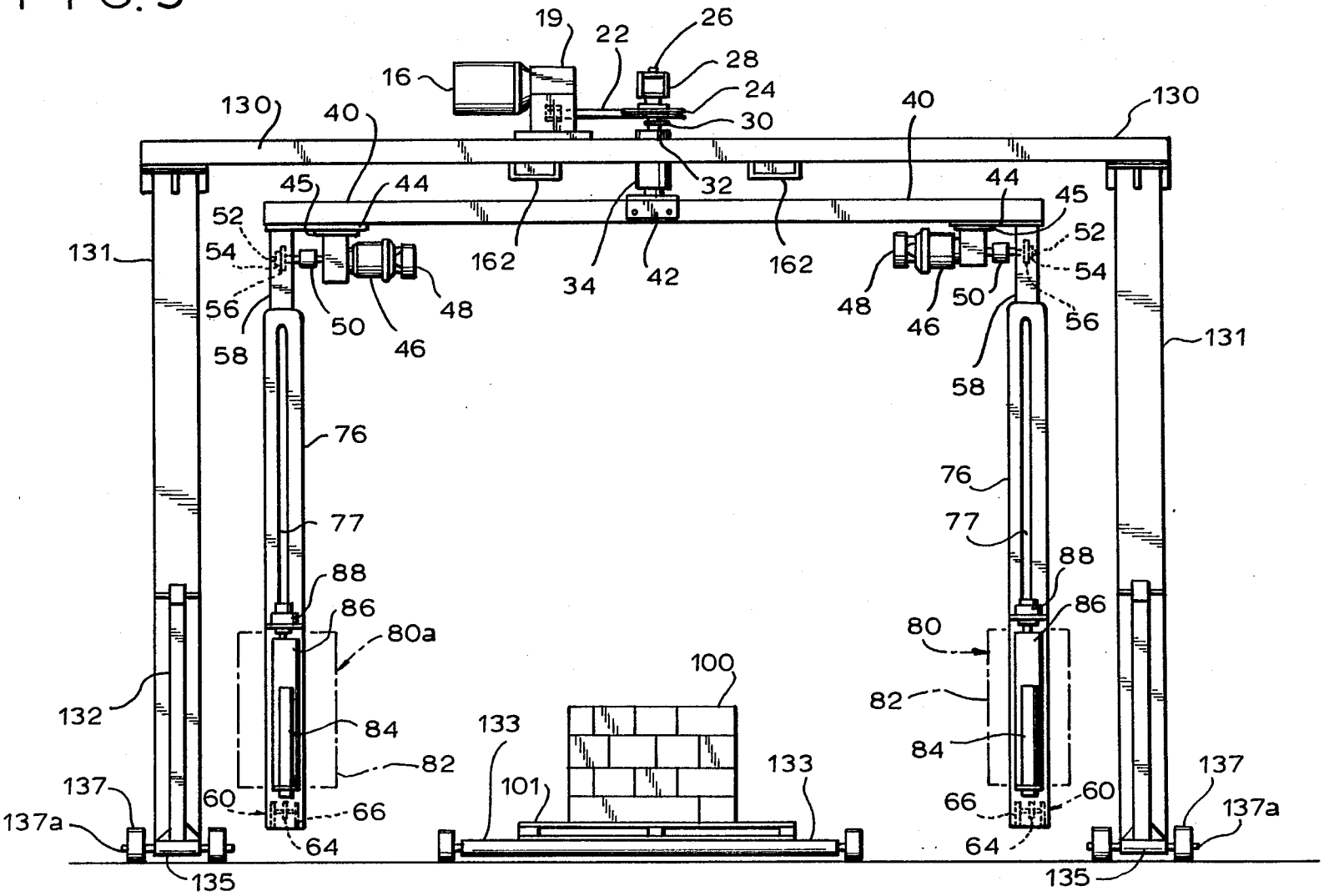
FIG. 3 shows a front elevational view of a gantry mounted overhead film wrapping apparatus, including the gantry supports thereof and a phantom line for a multiple film dispensing device associated therewith or with the devices also illustrated in FIGS. 1 and 2.

In FIG. 3, a gantry type of film wrapping apparatus has been depicted showing the gantry 130 and gantry supports 131. Motor 16 is interconnected in a slightly different but equivalent manner as in connection with the device shown in FIGS. 1 and 2 for driving rotor arm 40. This interconnection will be shown in FIG. 6.

In all other respects the gantry type device operates in the same manner as the device as shown in FIGS. 1 and 2. The length of the gantry uprights 131 may thus be appropriately selected and positioned above the floor and above a conveyor 133, as schematically illustrated in FIG. 3.

Figure 3A:
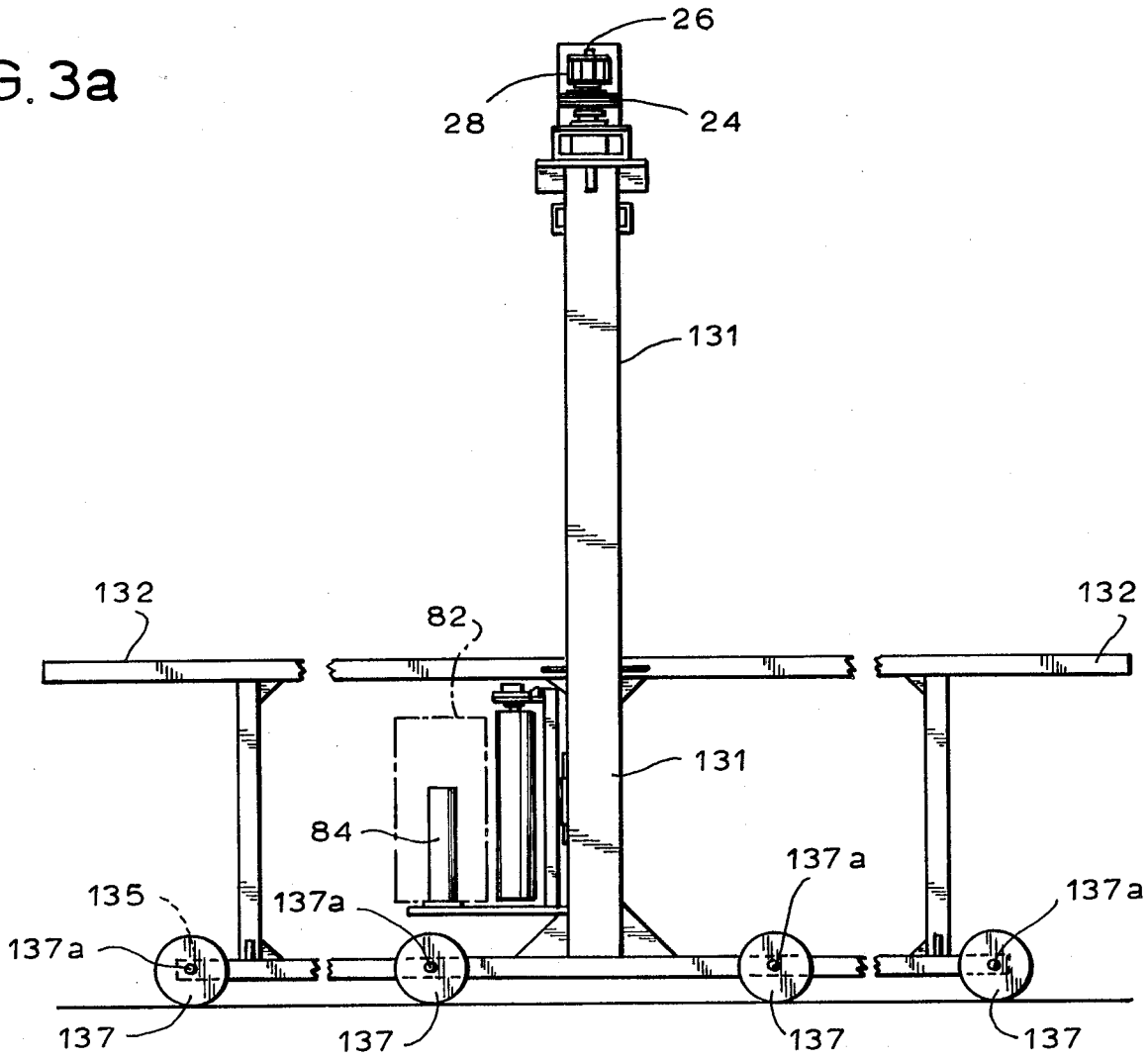
FIG. 3*a* shows a side elevational view of the device shown in FIG. 3, including various safety and/or conveyor means associated therewith.

The gantry uprights 131 may have appropriate railings 132 attached thereto such as shown in FIG. 3*a*. Railings 132 are for security and safety, but may also form part of an undercarriage 135 for the gantry uprights 131 so that the gantry may be moved and relocated where needed on the floor of a building.

During the wrapping operation the gantry wheels 137 may be removed or an appropriate brake (not shown) applied to all the wheels 137 so that the gantry is firmly placed and is not torque displaced by the upright arm 58 as it moves around the load.

An additional variant has been shown in phantom lines for the rotating rotor arm 40, as well as the upright arm 76. Thus two film dispensers 80 may be operating in unison or in variable film dispensing configuration as the film is being wrapped around load 100. The advantages reside in the ability to have one film being deposited in the spiral fashion by controlling the motor 46, that is, moving it up and down at an appropriate rate vis-a-vis the rate of rotation of the rotor arm 40, while the other and opposite relative motion for the film device 80 may take place.

Such wrapping, as well as mixed mode wrapping, heretofore has not been possible in a single device in single path wrapping applications.

Inasmuch as all of the combinations are possible by the controlled positioning of the film dispensing device 80 during the rotation of rotor arm 40, any device which combines the relative movement of the film dispensing device 80 vis-a-vis the load 100 during the wrapping operation, i.e., rotation of rotor arm 40, may be employed for the left and righthand film dispensing device, namely—80 and 80*a*.

In addition, the dispensers 80 and 80*a*, if used together, accomplish the wrapping in a considerably shorter time, yet with a greater assurance of load security and load integrity. This is especially wanted when the loads have to be distributed over fairly poor roads or poor terrain, and load integrity demands an outstandingly wrapped package. Such has been possible with a device as disclosed herein and shown in FIGS. 1 to 3 and the various embodiments thereof. Thus by employing a variable speed motor 46 such as shown for the device in FIG. 3, very outstanding wrapping can be achieved on a package with a single or double film dispensing device 80 and 80*a*.

Turning now to FIG. 4, it illustrates the rotor arm 40 interconnection with support for either the gantry type 130 of machine shown in FIG. 3, or in the stationary arm 11 type of machines illustrated in FIGS. 1 and 2. Although the illustration of the drive motor 16 is with reference to the gantry 130, the same construction technique may be applied or used for the other devices. Nevertheless, the embodiments shown in FIGS. 1 and 2 and the embodiments shown in FIGS. 3 and 4 all constitute alternative and equivalent embodiments of which the one shown in FIG. 4 is the preferred, although costlier, version.

Turning now to FIG. 4, it shows the previously described motor 16 and gear box 18, including the slip ring device identified as 28. Gear box 18 converts about 1700 rpm rotation of the DC motor of about $\frac{1}{2}$ horsepower to a speed of about 9 rpm in the gear box 18. Shaft 150 is connected directly to slip ring 28. Shaft 150 is appropriately keyed and has a shallow part 150*a* for the electric connections for upright arm 58 or limit switch 27.

Gear box 18 in turn is mounted on gear box plate 19. Shaft 150 extends through an aperture 151 in gear box motor mount plate 19 as shown in FIG. 4 and interconnects rotor arm support 42 via rotor arm shaft 152 shown in FIG. 4. In turn, shaft 152 is connected to rotor arm shaft mounting flange 154. Rotor arm shaft mounting flange 154 is welded onto rotor arm shaft 152, as is rotor arm support bracket 42. In turn, shaft 150 for motor 16 has a shaft bearing plate 155 which is welded onto shaft 150.

Bearing 156 for rotor arm shaft 152 consists of the inner race 157 and an outer race 157*a*. Typically, as shown in FIG. 4, bearing 156 is a ball bearing arrangement, although other arrangements may also be employed such as needle bearings, tapered roller bearings and the like. Inner race 157 is thus placed and secured to rotor arm shaft 152 and the motor shaft 150 by the rotor arm shaft mounting flange 154 and motor 16 shaft 150 by shaft bearing plate 155 by bolts 160, a pair of which have been shown in FIG. 4, but any suitable number of which may be employed for that purpose.

Outer race 157*a* for the bearing 156 for the rotor arm shaft 152 is supported by bearing plate support flange 158, such as shown for the gantry type model in FIG. 4.

As illustrated, the gantry 130 consists of a first support channel 130*a* and a second support channel of 130*b*. Thus bearing plate support flange 158 is welded onto the first and second support channels 130*a* and 130*b*. In turn, the outer race 157*a* of bearing 156 is bolted onto by bolts 160 to bearing plate support flange 158.

Gantry 130 is further provided with lifting channels 162. These lifting channels 162 have also been provided for stationary arm 11, as shown in FIGS. 1 and 2. Lifting channels 162 provide added rigidity to the structure shown, such as in FIGS. 1, 2 and 3, and also serve the function for appropriately moving the devices where necessary and for positioning and securement of these to the walls or the like.

In FIG. 5, rotor arm support bracket 42 has been shown in a top plan view, the cross-section of which has also been shown as 42 in FIG. 4. Thus, aperture 164 is for securing rotor arm shaft 152, as it has been shown in FIG. 4, and the additional bolt hole apertures 166, of which there are eight, are also shown either in FIGS. 4 or 5.

Turning now to FIGS. 6, 6*a* and 6*b*, these illustrate the embodiment where the film dispensing device 80 such as used with all of the machines is of the pre-stretch type as distinguished from the film dispensing embodiment shown in FIG. 1*b*. Thus the film dispensing device will now be discussed in terms of the variations thereof shown for the device in FIG. 2*b*. As this is a more complicated device and offers another advantageous embodiment, it has been separately identified as 170 and is of the pre-stretch type as shown in FIGS. 6, 6*a* and 6*b* (and also FIG. 2*b*). However, the common elements from the embodiments shown in FIGS. 1*b* or 3 have been identified with the same reference numerals.

The film dispensing device of the pre-stretch type 170, hereinafter called the pre-stretch film dispensing device 170, is likewise carried on carriage plate 70. Carriage plate 70 in turn is affixed to mounting post 89, as shown also in FIGS. 6*a* and 6*b*. Thus each of carriage plate 70 carries a pair of slides 74. Each of slides 74 has a notch 75 which fits on slide rail 76, further illustrated in FIGS. 7 to 7*b*.

Each of the slides 74 in turn has a slide support 78 in the form of a right angle bracket. Slides 74 are typically made of a suitable plastic material to facilitate the movement of film dispensing device 170 on slide rail 76. In turn, to the mounting post 89 is affixed the top bracket 178. A bottom bracket 180 has also been shown in FIG. 6*a*. Thus, mounting post top bracket 178 and mounting post bottom bracket 180 are welded onto mounting post 89. In turn, to mounting post top bracket 170 is affixed top roller bracket 179. Likewise, to the mounting post bottom bracket 180 is affixed bottom roller bracket 181. Brake roll 86, drive roll 172, and idler roll 174 are mounted thus between the top roller bracket 179 and bottom roller bracket 181. Drive roll 172 has a shaft 186 with a pair of bearings 187 or 188. The bottom roller bracket 81 further carries film roll tube holder 84 as shown in FIG. 6*b* in top plan view.

Idler roller shaft 176 has also been identified in FIGS. 6*a* and 6*b*. A geared motor 182 is for drive roll 172 via gear motor coupling 184 driving shaft 186. Shaft 186 has a pair of shaft bearings 186. Film 83 coming off film roll 82, shown in FIG. 1, is first trained around brake roll 86 and is retarded. Thereafter film 83 is trained around idler roll 174 and drive roll 172 and in this cooperation with rotor arm 40 winding around the package, the film is pre-stretched such that very little force is needed to wrap a load. The normal recovery after the film 83 has been wound around the package assures the integrity of the load being properly wrapped or secured.

Brake roll 86 has a shaft 188 and appropriate bearings 189 which are carried in bottom mounting plate 181 and top roller mounting plate 179. These allow shaft 188 to freely turn as adjusted by magnetic particle brake 190. This brake functions in an adjustable manner. Appropriate adjustments may be made by an operator by varying a potentiometer (not shown).

A planetary gear 194 for aiding magnetic particle brake 190, e.g., in a 3:1 ratio, helps to reduce in an appropriate manner the brake roll speed 86 and thus allows the pre-stretching between the drive brake roll 86 and drive roll 172.

Magnetic particle brake 190 in turn is mounted on brake mounting plate 192. Planetary gear 194 is mounted on planetary gear mounting plate 196. Four spacers 198 for the plate 192 and planetary gear mounting plate 196 have been shown in FIGS. 6 to 6*b*. A second set of four spacers 198 have been provided between the magnetic brake mounting plate 192 and planetary gear mounting plate 196. Further, a second set of spacers 198 have been provided between the planetary gear mounting plate 196 and top roller bracket 179. In a similar fashion, four spacers, one at each corner of motor 182 mounting plate 200, have been shown in FIGS. 6 and 6b. These spacers have been identified as 202. Spacers 202 and 198 are appropriate tubings to secure bolts 204.

As shown in FIGS. 6 to 6*a*, the pre-stretch film dispensing device 170 and 80 are readily interchangeable on upright arm 58 or any of the vertical variants thereof such as shown for FIGS. 2 and 3. In FIG. 3, a device as shown in the dashed lines may have a film dispensing device of the type identified as 80 and of the type as shown in FIG. 6, one on each arm thereof.

Figure 7:
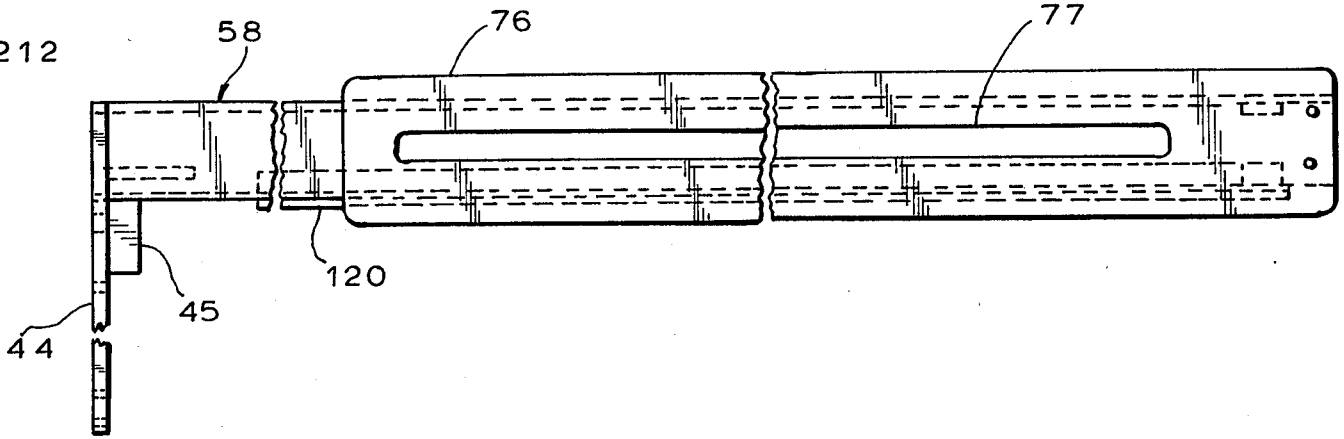
FIG. 7 illustrates in a side elevational view the upright arm also shown in FIGS. 1 to 3 adopted to receive, e.g., the film dispensing device as shown in FIG. 6.

FIG. 7 illustrates upright arm 58 in greater detail. It shows slide rail 76, as well as slide rail aperture 77 for chain tensioner 72, further identified in FIG. 8. Chain tensioner 72 rides in slide rail aperture 77 and positions carriage plate 70 at the desired location during the wrapping operation.

Magnetic guide 120 is for securing appropriately placed magnets 122 which activate appropriately located magnetic switches 121, which are stopped by magnets 122 as previously discussed above.

Upright arm 58 is secured to rotor arm 40 by gear motor mounting plate 44 identified in connection with gear motor 46. An appropriate gusset 45 for the gear motor mounting plate 44 provides sufficient rigidity for upright arm when the same is affixed to the rotor arm 40.

Figure 7A:
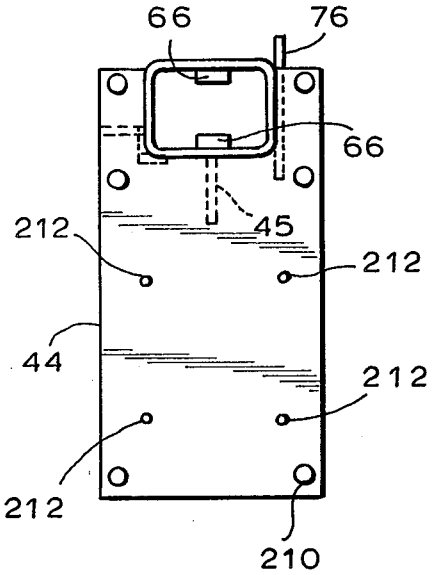
FIG. 7*a*, illustrates a bottom elevational view of the device shown in FIG. 7.

Bottom shaft collar 66, one on each side of the channel member used as the vertical upright 58, has been previously discussed in connection with FIG. 1. However, these have also been shown in FIGS. 7 and 7*a*. Apertures 210 for gear motor mounting plate 45 have been shown for securing via bolts and the like, the upright arm 58 to the rotor arm 40. In FIG. 7*a*, six apertures 210 have been shown, but additional ones may be provided as needed. Apertures 212 are for securing gear motor 46 to the gear motor mounting plate 44. A total of four apertures 212 have been shown in FIG. 7*a*. As previously discussed, top shaft sprocket 54 is secured in top shaft bearing aperture 56 which drives chain 68 and thus lifts or lowers the carriage plate 70.

Figure 8:
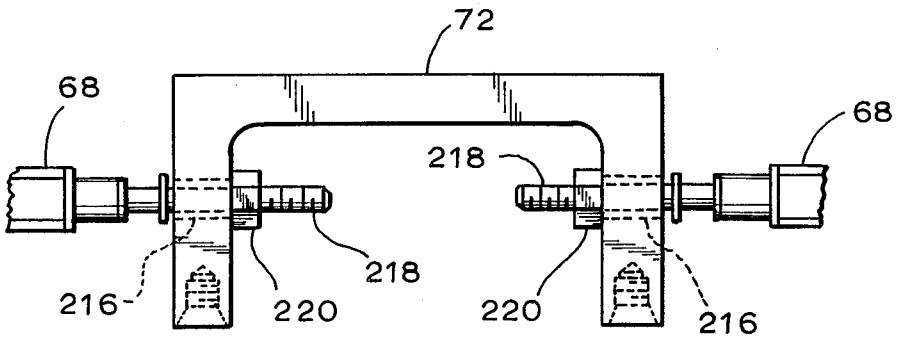
FIG. 8 illustrates the plan elevational view of the chain tensioning device used in combination with the upright device in FIGS. 1 and 7.

Turning now to FIG. 8, it illustrates the chain tensioner 72. Chain tensioner 72 is affixed to the carriage plate 70 by bolts secured in the threaded aperture 214. Chain tensioner 72 rides in slide rail aperture 77, shown in FIG. 7, as affixed to the carriage plate 70. A pair of apertures 216 are provided for securing threaded rod 218, one for each end of the chain 68. Threaded rods 218 are inserted in the aperture 216 and a nut 221 for each of the threaded rods 218 allows the appropriate tensioning of the chain. As thus secured, the chain tensioner 72 provides then the means for lowering and raising the carriage plate 70 in a controlled fashion.

As shown by the above description and the illustration of the embodiments shown in FIGS. 1, 2 and 3, these may be used in the method of wrapping appropriate loads such as described by the vertical arm 58 moving either in a horizontal circle or in a vertical circle. It is evident that the combination as provided herein confers a great number of advantages heretofore not provided by the prior art. Thus the various devices introduce heretofore unknown versatility and frees the present wrapping machinery from the constraints thought to be unavoidable. Still further, the devices as disclosed herein introduce combination wrapping heretofore not possible on a stationary load. Thus a combination wrapping with a full width film and at the same time of a narrower width film in a spiral fashion interleaved with the full width film or subsequently wound in a spiral fashion and without moving of the load is now possible. This ability is provided when the device such as shown in FIG. 1 is combined in a manner where the film dispensing device is of the type identified as 80 and 170 and described such as with respect to the latter in FIG. 6.

These variations are further provided where one of the devices may both be operating in a spiral fashion, but one may be of the pre-stretched device and the other of the regular stretch wrapping type, such as with respect to the previously disclosed film dispensing device 80 and 170, respectively.

As shown in FIG. 2, the present device may also be employed not only for wrapping a load which rests on a conveyor, but thereafter a device such as shown in FIG. 2 may be employed for wrapping the film 83 around the entire load such as a pallet or the like for further securement of the load on the pallet.

These advantages are outstanding and have been found to be especially desirable where the packaging of the loads must meet exceptionally high standards.

Having thus described the invention with reference to the drawings and the various embodiments, as well as the various combinations thereof, what is sought to be secured by the claims have been defined as follows.

What is claimed is:

1. Apparatus for wrapping a load with selected ones of stretched and prestretched films, the apparatus comprising:

a rotatable arm having first and second opposed ends;

pivot means defining a pivot point on said rotatable arm intermediate said first and second ends for mounting said rotatable arm facing a location for wrapping said load;

motor means for rotating said rotatable arm around said pivot point in a selected one of clockwise and counterclockwise directions;

control means responsive to said motor means for controlling said rotation of said rotatable arm to a selected rate of rotation;

first and second parallel support arms perpendicular to said rotatable arm and mounted on said first and second ends, respectively, so as to encompass said location therebetween;

first and second carriage means mounted for movement along said first and second support arms, respectively, said first carriage means including first film dispensing means for dispensing a first film having a first width and said second carriage means including second film dispensing means for dispensing a second film having a second width;

first and second drive means for independently moving said first and second carriage means along said first and second support arms, respectively; and movable gantry means for positioning said pivot point over said location with said load thereat, said gantry means including conveyor means for placing said load substantially under said pivot point.

2. Apparatus according to claim 1, wherein said first width of said first film is substantially equal to a wrap dimension of said load parallel to said support arms and said second width of said second film is smaller than said first width, and wherein, during rotation of said rotatable arm, said first drive means holds said first carriage means stationary on said first support arm with said first width substantially coterminous with said wrap dimension and said second drive means moves said second carriage means along said second arm over a distance substantially coterminous with said wrap dimension.

3. A method for wrapping a load with selected ones of stretched and prestretched films, said method comprising the steps of:

positioning said load intermediate a first film dispenser dispensing a first film having a first width and a second film dispenser dispensing a second film having a second width;

rotating said first and second film dispensers about said load to wrap said first and second films therearound; and selectively moving said second film dispenser relative to said first film dispenser in an axial direction perpendicular to the rotational movement thereof during said rotational movement.

4. A method according to claim 3, wherein said first width of said first film is substantially equal to a wrap dimension of said load parallel to said axial direction and said second width of said second film is smaller than said first width, and wherein said step of selectively moving includes holding said first film dispenser stationary in said axial direction with said first width substantially coterminous with said wrap dimension while moving said second film dispenser in said axial direction over a distance substantially coterminous with said wrap dimension.

* * * * *